US012582175B2

(12) United States Patent
Dresp

(10) Patent No.: US 12,582,175 B2
(45) Date of Patent: Mar. 24, 2026

(54) COAT WITH BAG AND PET CARRIERS AND WEIGHTED HOOD

(71) Applicant: Rebekah L. Dresp, Charlotte, NC (US)

(72) Inventor: Rebekah L. Dresp, Charlotte, NC (US)

( * ) Notice: Subject to any disclaimer, the term of this patent is extended or adjusted under 35 U.S.C. 154(b) by 0 days.

(21) Appl. No.: 18/818,008

(22) Filed: Aug. 28, 2024

(65) Prior Publication Data

US 2025/0072536 A1 Mar. 6, 2025

Related U.S. Application Data

(60) Provisional application No. 63/535,288, filed on Aug. 29, 2023.

(51) Int. Cl.
*A41D 3/02* (2006.01)
*A41D 13/00* (2006.01)
*A45F 3/14* (2006.01)

(52) U.S. Cl.
CPC ..... *A41D 13/0012* (2013.01); *A41D 3/02* (2013.01); *A45F 3/14* (2013.01)

(58) Field of Classification Search
CPC ..... A41D 13/0012; A41D 3/02; A45F 3/14
USPC ..... 2/93; 119/497
See application file for complete search history.

(56) References Cited

U.S. PATENT DOCUMENTS 1,650,491 A * 11/1927 Calvert ..... A41D 13/0012 224/103
4,402,440 A * 9/1983 Purtzer ..... A47D 13/025 224/264
D370,090 S * 5/1996 Coggins ..... D3/214
5,560,043 A * 10/1996 Armstrong ..... A41D 15/00 2/85
6,481,606 B2 * 11/2002 Pickett ..... A01K 1/0254 224/640
6,701,871 B1 * 3/2004 Johnson ..... A01K 1/0254 119/500
7,296,303 B1 * 11/2007 Samet ..... A41D 1/04 2/115
9,398,816 B2 * 7/2016 Simmer ..... A41D 27/20
9,961,949 B2 * 5/2018 Rojas ..... A41D 27/10
10,321,661 B2 * 6/2019 Kath ..... A01K 1/0263
2003/0200937 A1 * 10/2003 Muckleroy ..... A01K 1/029 119/497
2004/0035899 A1 * 2/2004 Reynolds ..... A45F 3/14 224/585
2004/0172734 A1 * 9/2004 Hartbrodt ..... A41D 13/02 2/97
2006/0005294 A1 * 1/2006 Fugazzi ..... A41D 1/04 2/115
2006/0005782 A1 * 1/2006 Fugazzi ..... A01K 1/029 119/497

(Continued)

FOREIGN PATENT DOCUMENTS

JP 6967237 B1 * 11/2021

*Primary Examiner* — Jameson D Collier
(74) *Attorney, Agent, or Firm* — Carlos R. Villamar; The Villamar Firm PLLC

(57) ABSTRACT

A coat system, includes a coat with an interior configured for carry, storage, and concealment of items including at least one of a handbag and pet carrier; a strap system within the interior of the coat, wherein the handbag or pet carrier can be connected to one or more hooks integrated with the strap system; and a weighted element in a hood of the coat enabling the hood to stay on a head of a user.

14 Claims, 11 Drawing Sheets

(56) References Cited

U.S. PATENT DOCUMENTS

| | | | | |
|---|---|---|---|---|
| 2006/0162041 | A1* | 7/2006 | Tengbom | A41F 5/00 2/85 |
| 2010/0320241 | A1* | 12/2010 | Thompson | A45F 4/12 2/243.1 |
| 2011/0030118 | A1* | 2/2011 | Pratchett | A62B 35/0025 2/243.1 |
| 2013/0212788 | A1* | 8/2013 | Curtis | A62B 17/003 2/455 |
| 2014/0189930 | A1* | 7/2014 | Solomon | A47D 13/025 2/69 |
| 2016/0262354 | A1* | 9/2016 | Rojas | A01K 29/00 |
| 2018/0184730 | A1* | 7/2018 | Autard | A41D 27/04 |
| 2020/0238045 | A1* | 7/2020 | Pacheco | A61M 21/02 |

* cited by examiner

COAT WITH BAG AND PET CARRIERS AND WEIGHTED HOOD

CROSS REFERENCE TO RELATED DOCUMENTS

The present invention claims priority to U.S. Provisional Patent Application Ser. No. 63/535,288 of Rebekah L. DRESP, entitled "COAT WITH BAG AND PET CARRIERS AND WEIGHTED HOOD," filed on 29 Aug. 2023, the entire disclosure of which is hereby incorporated by reference herein.

BACKGROUND OF THE DISCLOSURE

Field of the Disclosure

The present disclosure generally relates to coats, and more particularly to a coat having bag and pet carriers and with a weighted hood, and the like.

Discussion of the Background

In recent years, various coats, and the like, have been developed. However, such coats typically are lacking in effective incorporation bag and pet carriers and weighted hoods, in an efficient and cost-effective manner.

SUMMARY OF THE DISCLOSURE

Therefore, there is a need for a coat system that addresses the above and other problems. The above and other problems are addressed by the illustrative embodiments of the present disclosure, which provide a coat system that incorporates bag and pet carriers and weighted hoods, and the like. In illustrative embodiments, the coat system includes a handbag concealment coat with "stay put" hood, wherein a handbag can be hooked on an interior of the coat, the coat can have a built-in bag and/or pet carrier and with a weighted element in the hood enabling the hood to stay on the head, effortlessly. For example, a women's coat is described including built in elements to facilitate the carry, storage, and concealment of a women's handbag, and the like, on the interior of the coat. In addition, the disclosure includes adaptations for a built-in handbag and a built-in pet carrier, and with a weighted element built into the top of the hood of the coat enabling the hood to stay on top of the head.

Accordingly, in illustrative aspects of the present disclosure there is provided a coat system, including a coat with an interior configured for carry, storage, and concealment of items including at least one of a handbag and pet carrier; a strap system within the interior of the coat, wherein the handbag or pet carrier can be connected to one or more hooks integrated with the strap system; and a weighted element in a hood of the coat enabling the hood to stay on a head of a user.

The strap system is configured to secure a women's handbag.

The coat system can include a built-in bag within the interior of the coat integrated with the strap system.

The coat system can include a built-in pet carrier within the interior of the coat integrated with the strap system.

The weighted element is integrated into the top of the hood of the coat.

The weighted element is configured to distribute weight evenly on the top of the hood of the coat.

The coat is configured a women's coat and including built-in elements specifically designed to facilitate the carry and concealment of the handbag configured as a women's handbag.

The handbag or pet carrier is integrated into the design of the coat.

The strap system is configured with adjustable connectors and securing mechanisms for various types and sizes of handbags or pet carriers.

The strap system further includes a set of retractable hooks or clasps configured to provide support and security.

Still other aspects, features, and advantages of the present disclosure are readily apparent from the following detailed description, by illustrating a number of illustrative embodiments and implementations, including the best mode contemplated for carrying out the present disclosure. The present disclosure is also capable of other and different embodiments, and its several details can be modified in various respects, all without departing from the spirit and scope of the present disclosure. Accordingly, the drawings and descriptions are to be regarded as illustrative in nature, and not as restrictive.

BRIEF DESCRIPTION OF THE DRAWINGS

The embodiments of the present disclosure are illustrated by way of example, and not by way of limitation, in the figures of the accompanying drawings and in which like reference numerals refer to similar elements and in which.

DETAILED DESCRIPTION OF THE PREFERRED EMBODIMENTS

Figure 1:
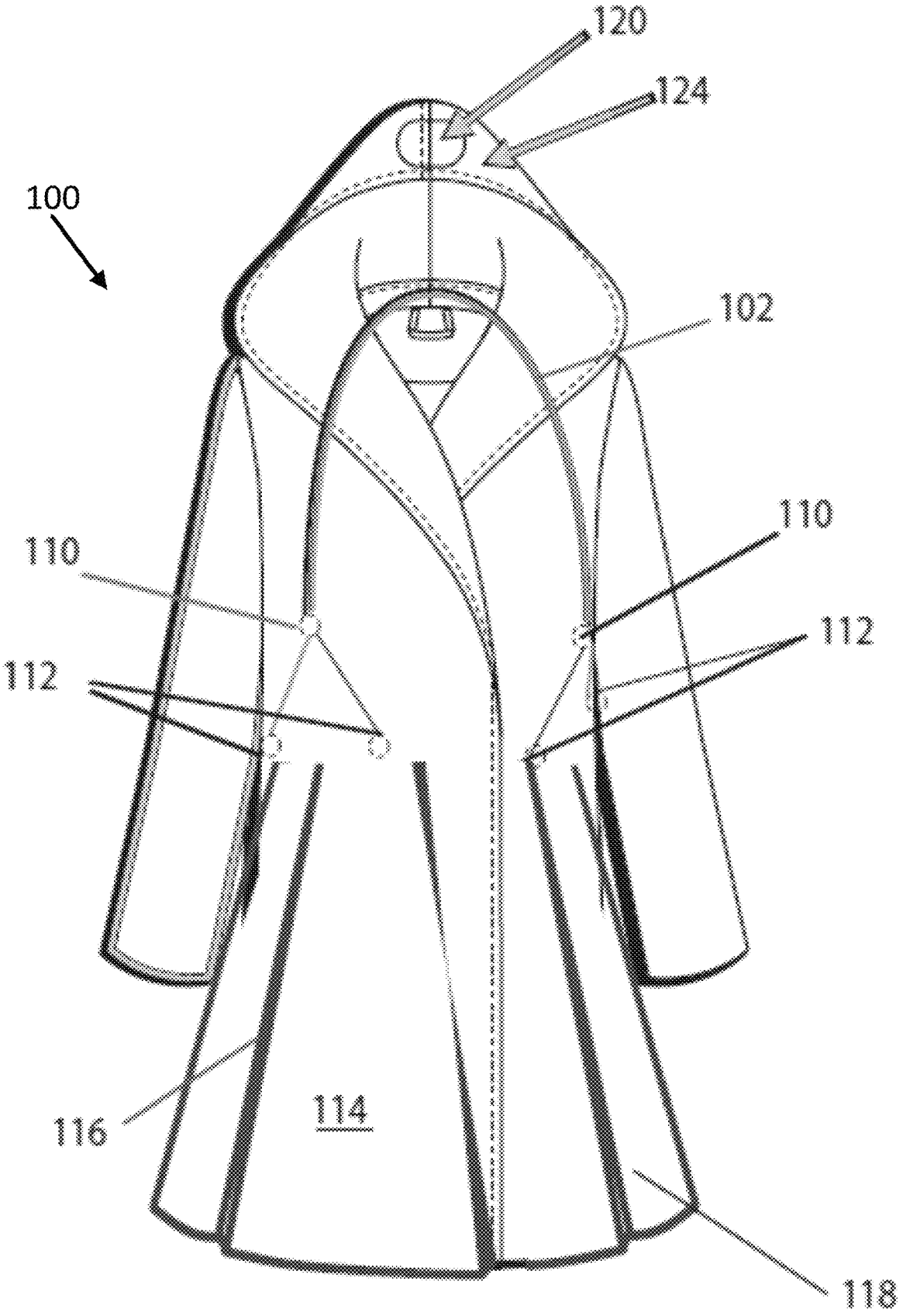
FIG. 1 is a diagram illustrating a coat system including an integral strap system for securing a handbag, and the like, in an interior of a coat, according to the present disclosure.

The present disclosure includes recognition of the problem that women's coats throughout the years have served two basic features, fashion, or function. Rarely are the two accomplished together. One may have a very fashionable coat with two standard pockets that are well-designed in fashion forward style, or one might seek out a coat with more functions, such as with several pockets to facilitate a phone, a water bottle, a wallet, and the like. What has not been accomplished is a coat that carries a women's handbag on the interior of the coat.

The present disclosure further includes recognition of the problem that women love their handbags and spend a lot of money on them, and often the handbags are very expensive status symbols. Unfortunately, that also makes such handbags stand out to potential thieves. For example, if one finds oneself walking down the streets of New York City, one might want to carry the most expensive bag to show it off. However, one will hesitate, because the crime rate and the crowds might make them fear that someone might steal it right off their shoulder, especially if having to wear the handbag over a heavy coat, and the like, making one more vulnerable. Accordingly, one may likely leave their nice bag at home and opt for a crossbody handbag, and the like, that is not too flashy for safety reasons, and the like.

The present disclosure further includes recognition of the problem that when one is out wearing a nice leather handbag and it begins to snow or rain heavily, one must carry their handbag outside in the snow or rain, which can damage the handbag. Accordingly, if one thought that it might snow or rain, they would not carry a nice handbag that could be damaged by the weather, as they spent a lot of money on the bag and want to protect it and its contents.

Advantageously, according to the present disclosure, by enabling a handbag to be carried inside a coat, a woman doesn't have to choose between her status handbag and her safety handbag, and the like, as she can secure the handbag inside her coat until she is in a safe location inside and can remove it easily to set it on the table, and the like. Advantageously, she can reveal her handbag when it is safe and conceal it as needed. She also will not have to ditch her handbag for a hundred pockets in her coat that are intended to take the place of the bag that she loves.

Accordingly, this disclosure includes a coat with secured hooks for a handbag on the interior of a coat, for example, using an integral or separate strap system, and the like (e.g., made from suitable strap materials, such as nylon, polyester or polypropylene webbing and/or combinations thereof). The strap system can include three straps that wrap around the neck and are secured between the outer shell of the coat and the interior lining of the coat. Advantageously, the strap system provides individual support for the three hooks on each side of the coat. One small hook on the upper portion of the coat can be used for smaller handbags and the two hooks below the small hook can be used for larger handbags with long straps where one can attach the handbag on both sides of the bag onto both hooks. The strap system can be further modified for an optional built-in bag, built-in pet carrier, and the like, using the straps in the strap system for support, and the like. The design of the coat employs strategic box pleats to create a cavity on the coat design, advantageously, enabling the bag to rest, typically undetected underneath the coat, and the like. The coat also can include a built-in hood with a weighted element on the top of the hood that rests comfortably on the top of the head to keep the hood secure without effort.

Accordingly, a fashionable women's coat is provided with the functions of purse hooks inside of the coat, a built-in bag inside of the coat, a built-in pet carrier inside of the coat and a hood that is designed to stay on top of the head comfortably and effortlessly. An adaptation to the coat includes a strap system located in between the interior lining of the coat and the outer shell as well as a design modification using large box pleats to create a cavity on the lower interior of the coat, and the like.

Referring now to the drawings, wherein like reference numerals designate identical or corresponding parts throughout the several views, and more particularly to FIG. 1 thereof, there is illustrated a coat system 100 including an integral strap system 102 for securing a handbag, and the like, in an interior of a coat, according to the present disclosure. In FIG. 1, the coat system 100 can include the strap system 102, for example, that runs around and behind the neck, between an inner lining and outer shell of a coat. The coat system 100 also includes a plurality of sections 114-118 and 120-124 that perform various functions. For example, box cavity 114 is achieved by box pleats 116 in the design of the coat and similarly is repeated on the other side of the coat to achieve box cavity 118. The box cavities 114 and 118 are a design element of the coat that aids in the concealment of a handbag, and the like, underneath the coat. The strap system 102 can be made from suitable strap materials, such as nylon, polyester or polypropylene webbing and/or combinations thereof, and the like.

Figure 2:
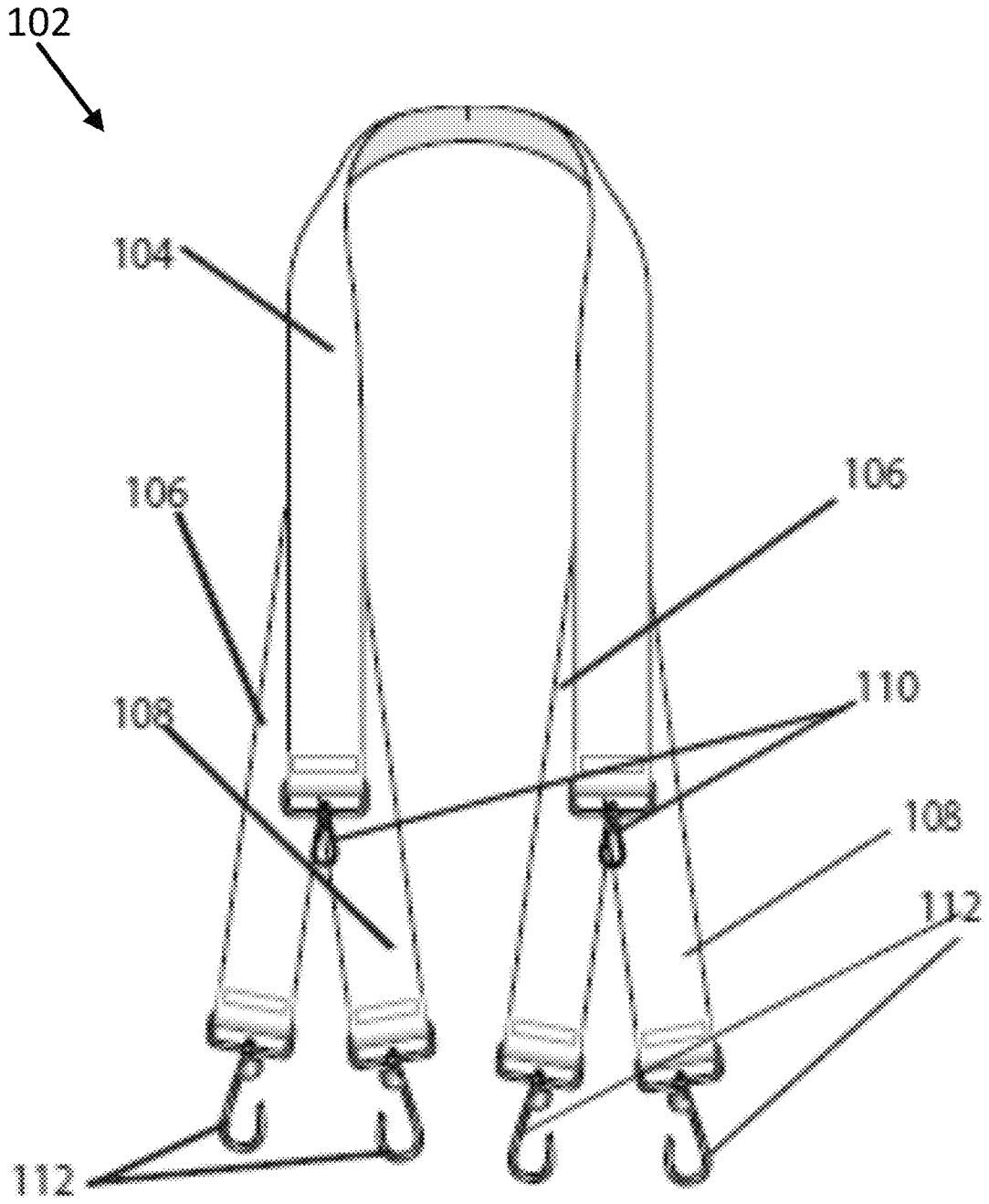
FIG. 2 is a diagram illustrating further details of an integral strap system, according to the present disclosure.

FIG. 2 is a diagram illustrating further details of an integral strap system 102, according to the present disclosure. In FIG. 2, the strap system 102 wraps around the neck and can include, for example, three straps, 104, 106 and 108, and the like. Advantageously, the straps 104, 106 and 108 provide independent and reinforced strength for the respective hooks 110 and 112. The strap 104 can be the shorter of the straps to support hooks 110 on both sides thereof. The straps 106 and 108 can be longer independent straps used to support hooks 112 on both sides thereof, and to provide for various advantageous adaptations, and the like.

Figure 3:
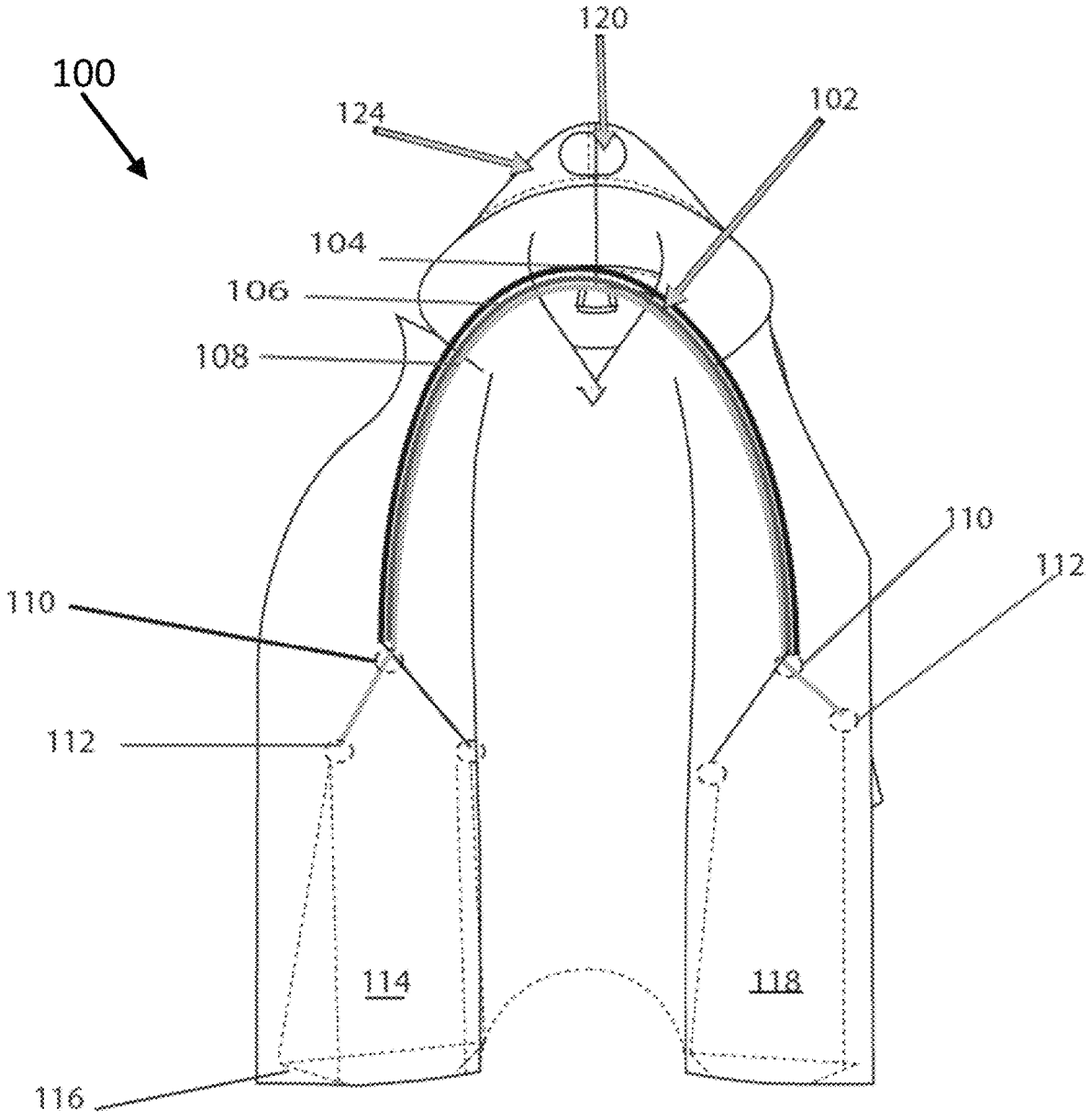
FIG. 3 is a diagram illustrating an interior view of a coat system including an integral strap system for securing a handbag, and the like, according to the present disclosure.

FIG. 3 is a diagram illustrating an interior view of the coat system 100 including the integral strap system 102 for securing a handbag, and the like, according to the present disclosure. In FIG. 3, the coat system 100 with the strap system 102 includes the cavities sections 114 and 118 created by the design box pleats 116, as shown from an interior of the coat.

Figure 4:
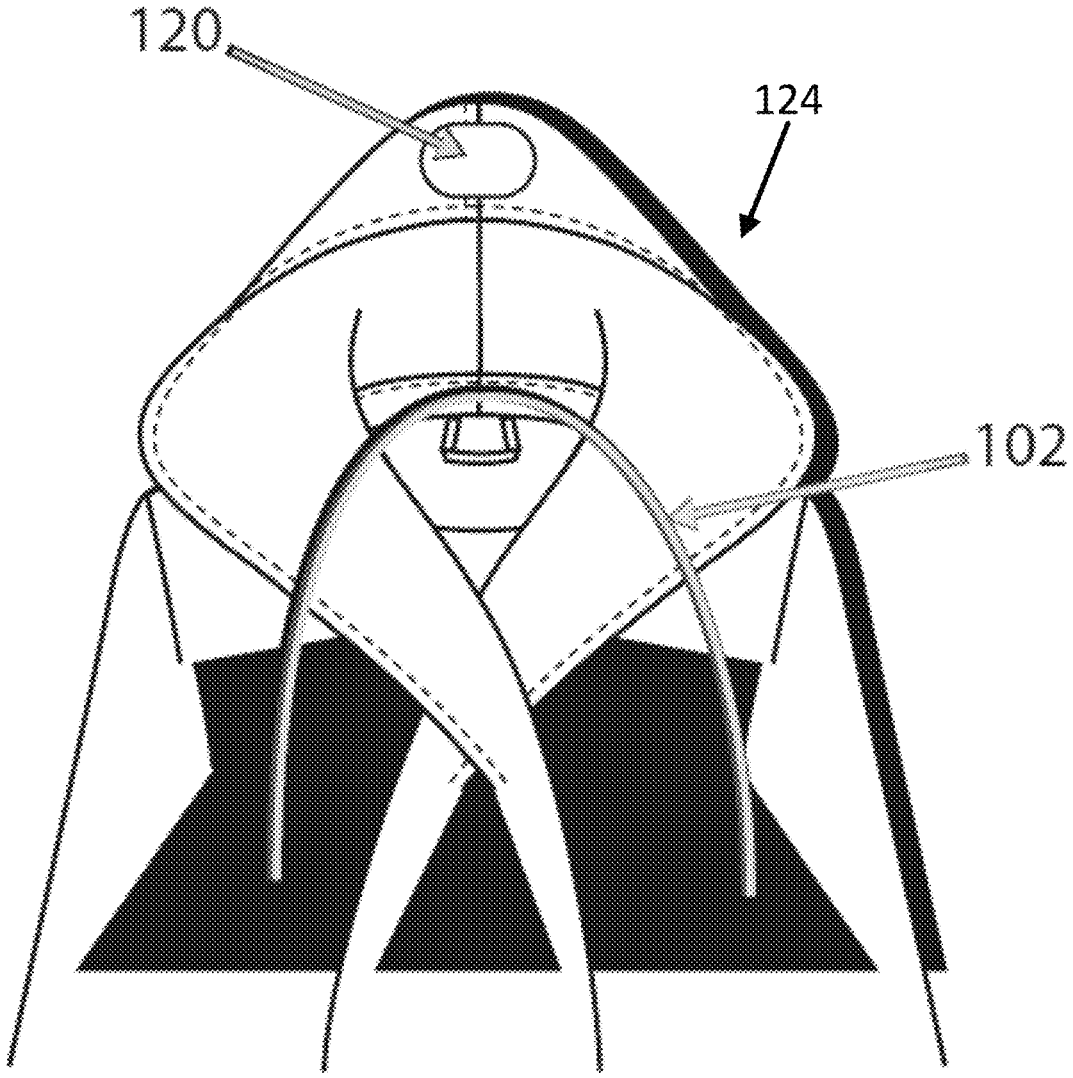
FIG. 4 is a diagram illustrating a view of a weighted hood with weighted elements on a center top of the hood, according to the present disclosure.

FIG. 4 is a diagram illustrating a view of a weighted hood 124 with weighted elements 120 on a center top of the hood 124, according to the present disclosure. In FIG. 4, the weighted hood 124 includes the weighted elements 120 on the center top of the hood, advantageously, configured to allow the hood 124 to stay on the head of a user.

Figure 5:
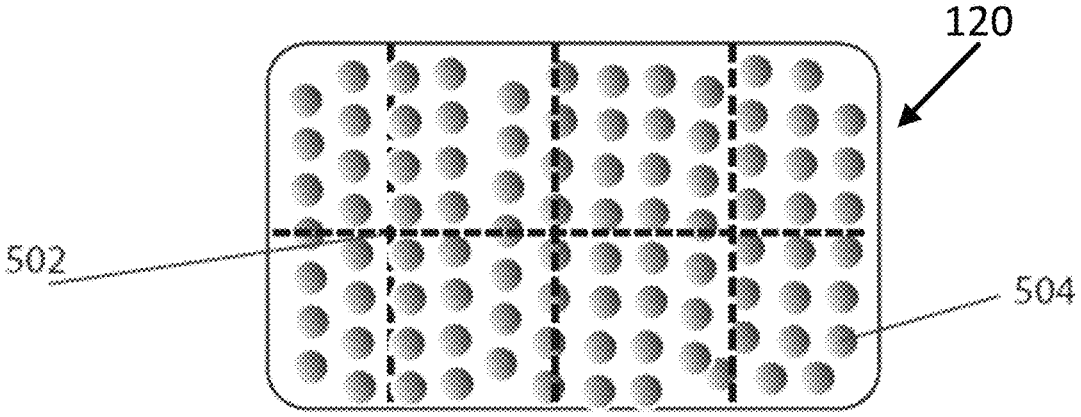
FIG. 5 is a diagram illustrating a detailed view of weighted elements on a hood, according to the present disclosure.

FIG. 5 is a diagram illustrating a detailed view of weighted elements 120 on the hood 124, according to the present disclosure. In FIG. 5, the weighted elements 504, for example, such as weighted beads, sand, and the like, are evenly distributed thereacross by seams 502. The weighted hood 124 is configured to be relatively light but heavy enough to create a support that rests on the head, advantageously, enabling the hood 124 to stay on the head with little effort. The exact size and shape of weighted elements 120 can vary depending on hood design, style, and the like, using any suitable weight and element materials, as will be appreciated by those of ordinary skill in the relevant art(s).

Figure 6:
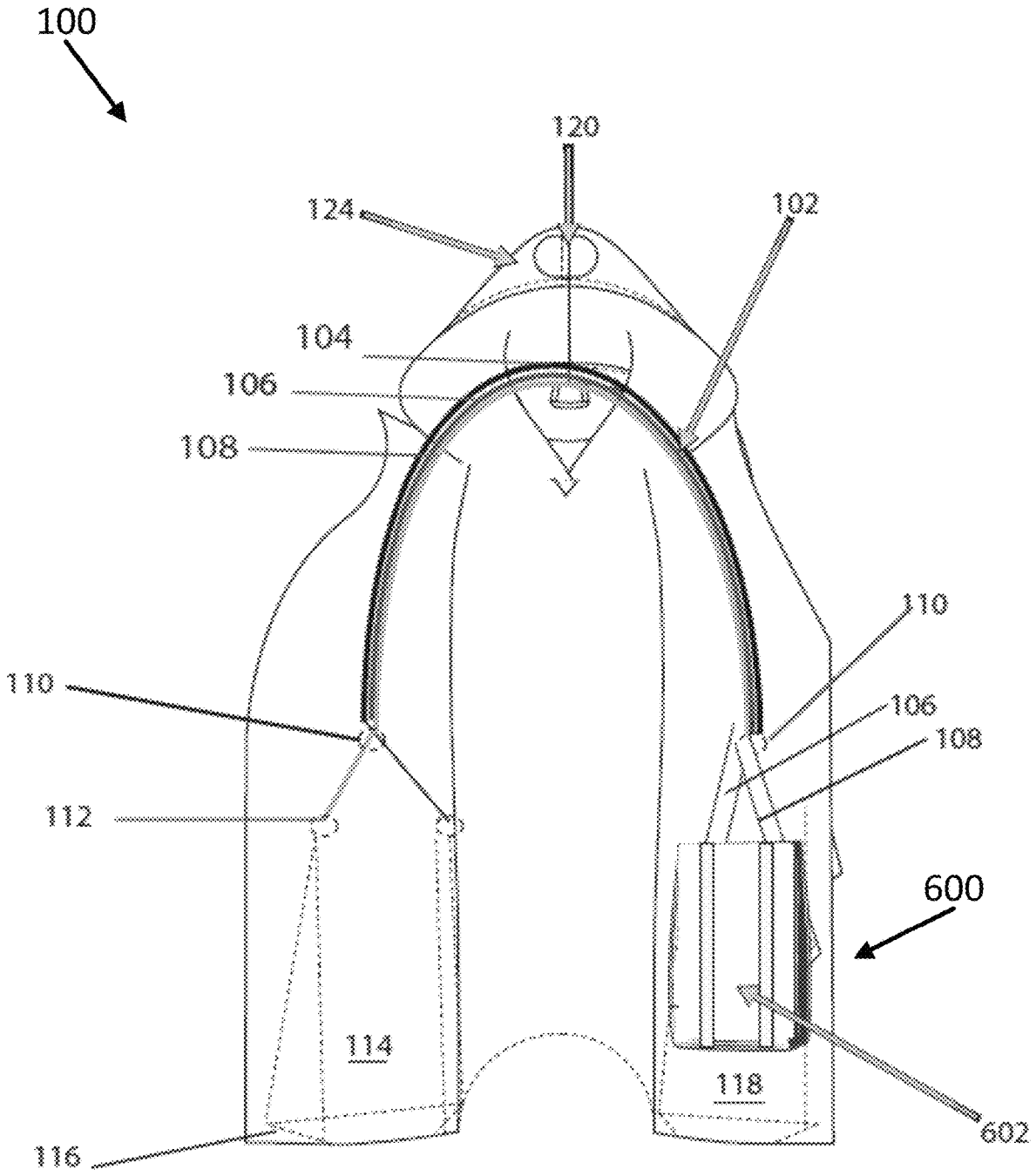
FIG. 6 is a diagram illustrating a strap system, including a built-in bag system, according to the present disclosure.

FIG. 6 is a diagram illustrating the strap system 102, including a built-in bag system 600, according to the present disclosure. In FIG. 6, the original strap system 102 is configured to add a built-in bag 602 on one or both sides thereof.

Figure 7:
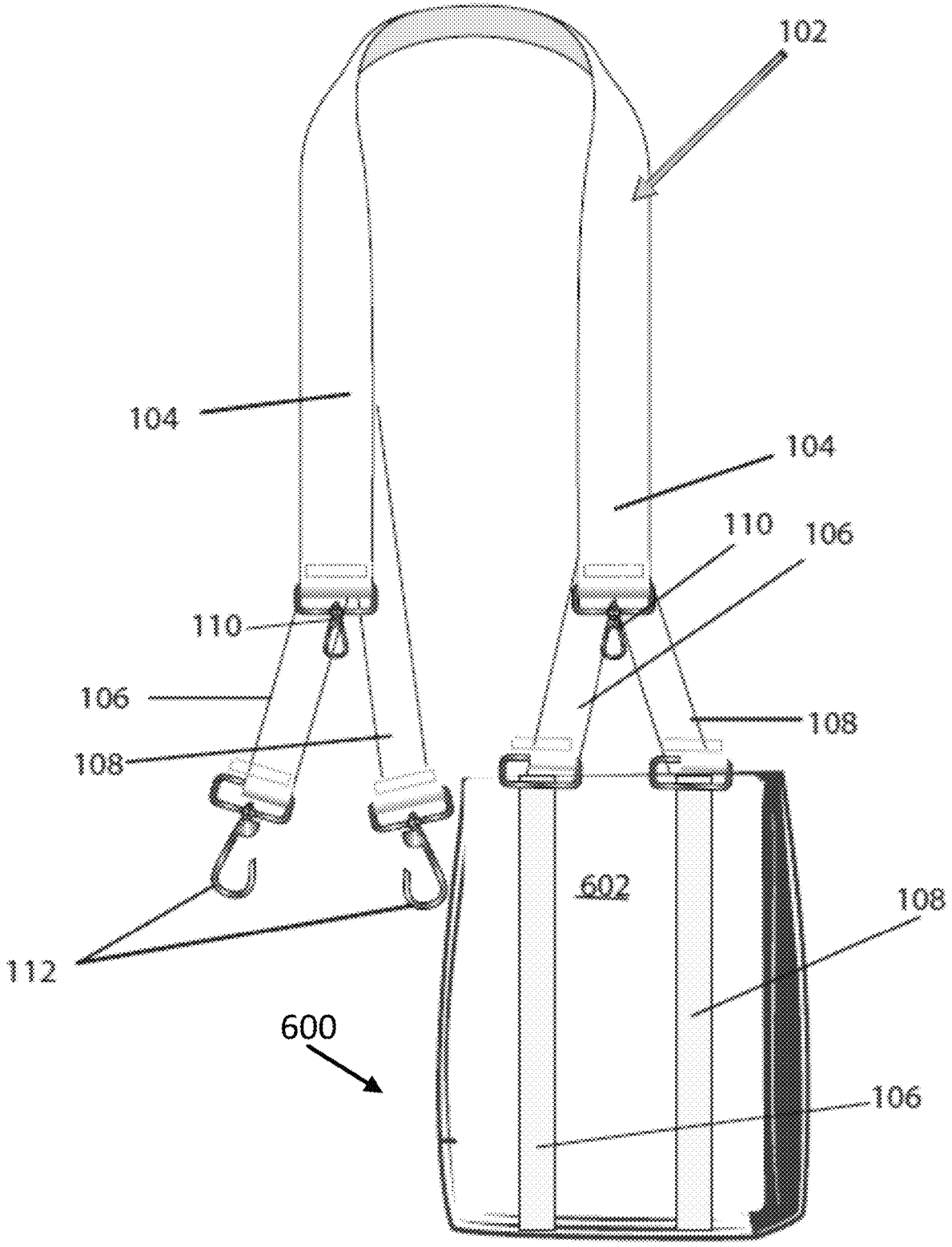
FIG. 7 is a diagram illustrating a detailed view of a strap system, including a built-in bag, according to the present disclosure.

FIG. 7 is a diagram illustrating a detailed view of the strap system 102, including the built-in bag 602, according to the present disclosure. In FIG. 7, the built in bag system 600 employs the strap system 102, wherein elongated straps 108 and 106 on one or both sides are configured to wrap around the bag 602 to create a support for the bag system 600. The strap system 102 otherwise remains the same, except for the built in bag system 600. The built-in bag system 600, advantageously, can also include an access pocket (not shown) on the exterior of the coat, as needed.

Figure 8:
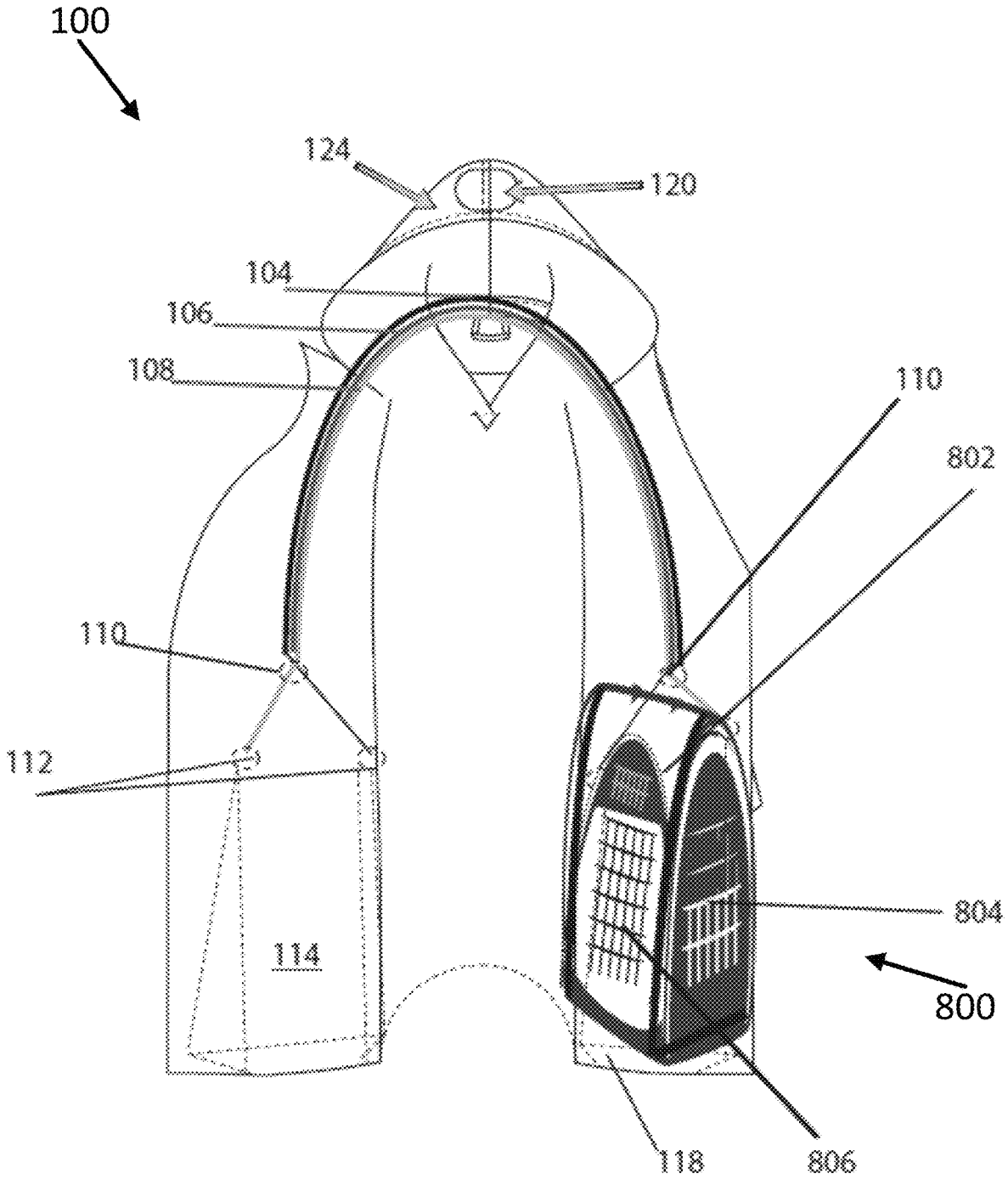
FIG. 8 is a diagram illustrating a built-in bag system configured as a pet carrier, according to the present disclosure.

FIG. 8 is a diagram illustrating a built-in bag system configured as a pet carrier, according to the present disclosure. In FIG. 8, the built-in pet carrier 802, advantageously, can be equipped with vinyl mesh 804 and 806 on sides thereof for pet viewing and ventilation.

Figure 9:
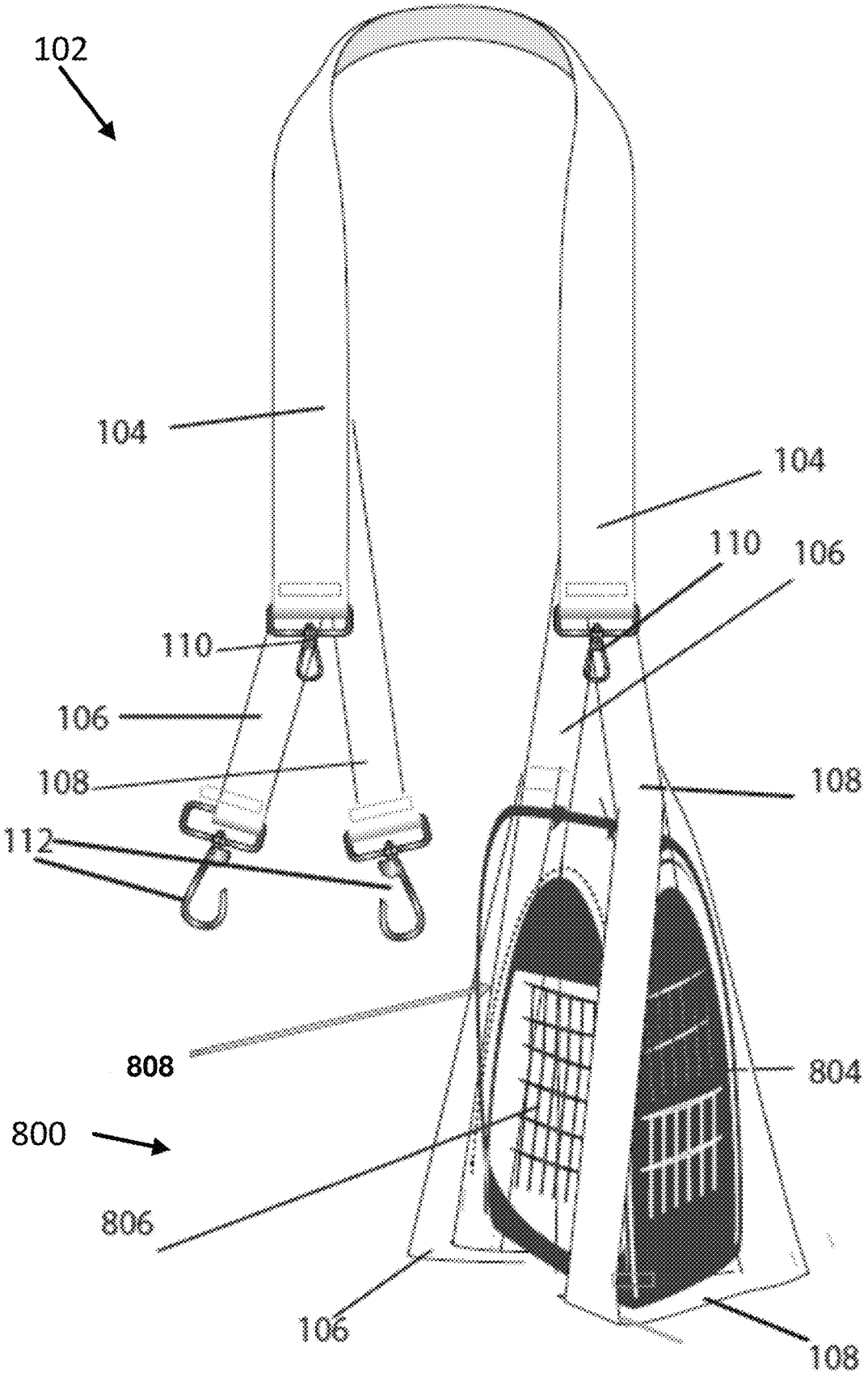
FIG. 9 is a diagram illustrating a detailed view of a built-in bag system configured as a pet carrier, according to the present disclosure.

FIG. 9 is a diagram illustrating a detailed view of the built-in bag system configured as the pet carrier 800, according to the present disclosure. In FIG. 9, the pet carrier 800 and the strap system 102 provide support via the reconfigured straps 106 and 108. The vinyl mesh front 806 is provided with an opening zipper 808 on a front thereof. The sides can include the vinyl mesh 804, which carry through to the exterior of the coat inside pleat 116 for ventilation. Adaptations of the ventilation system can vary by design and can also be located on the exterior of the coat and incorporated into the design or hidden by flaps or pockets. Adaptations of this element can also include an opening of the pet carrier on the exterior of the coat, according to further design.

Figures 10A, 10B, 10C:
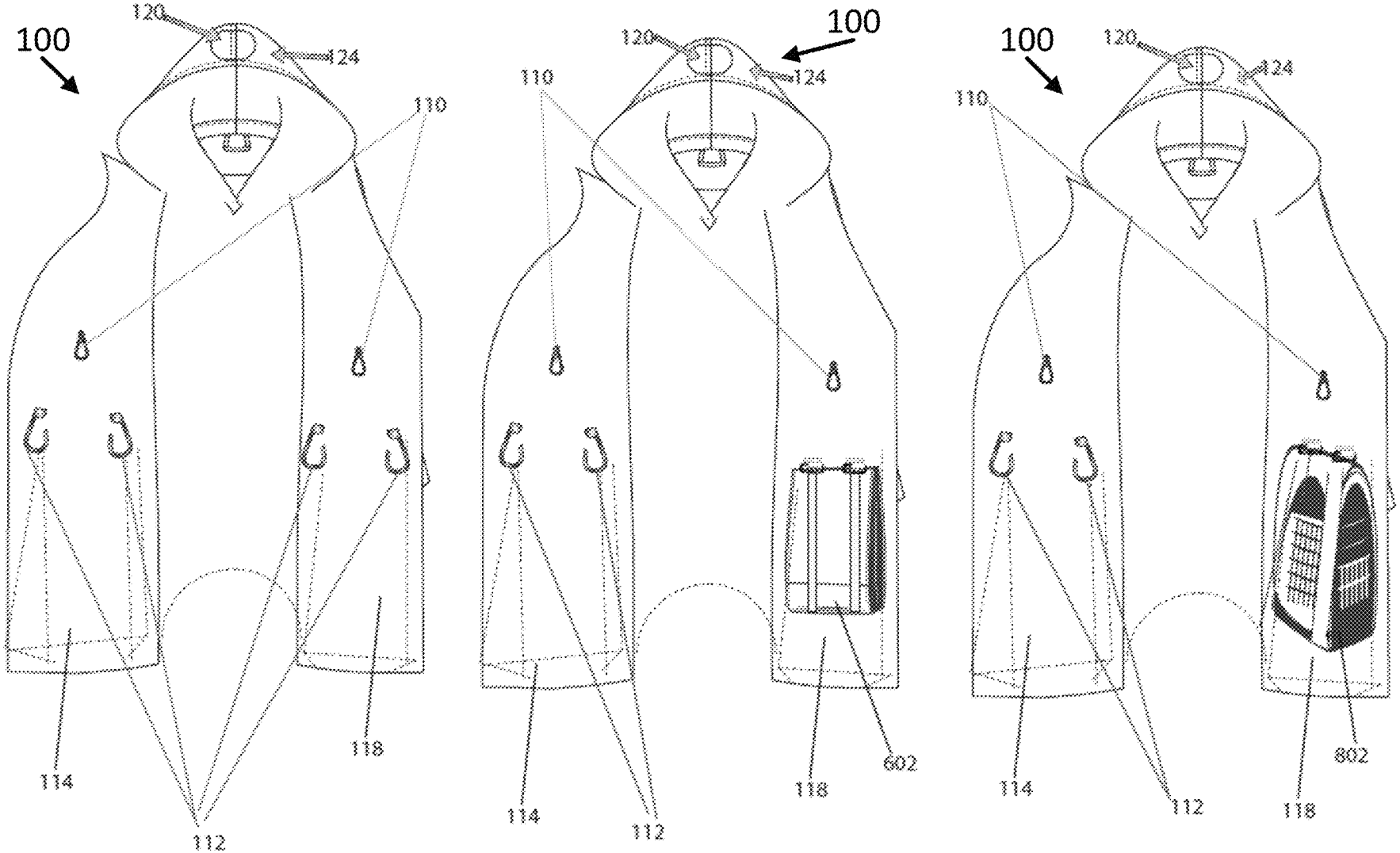
FIGS. 10A-10C are diagrams illustrating various adaptations of a coat system, according to the present disclosure.

FIGS. 10A-10C are diagrams illustrating various adaptations of the coat system 100, according to the present disclosure. In FIGS. 10A-10C, a left (or right) side of the coat can remain consistent with the hooks 110 and 112. In FIG. 10B, the hook 110 remains, but the hooks 112 can be replaced with the built in bag 602. In FIG. 10C, the hook 110 remains, but the hooks 112 are replaced with the pet carrier 802. Advantageously, the strap system 102 can be concealed by the interior lining of the coat, with visible elements of the strap system 102 being the hooks 110 and 112.

Figure 11A:
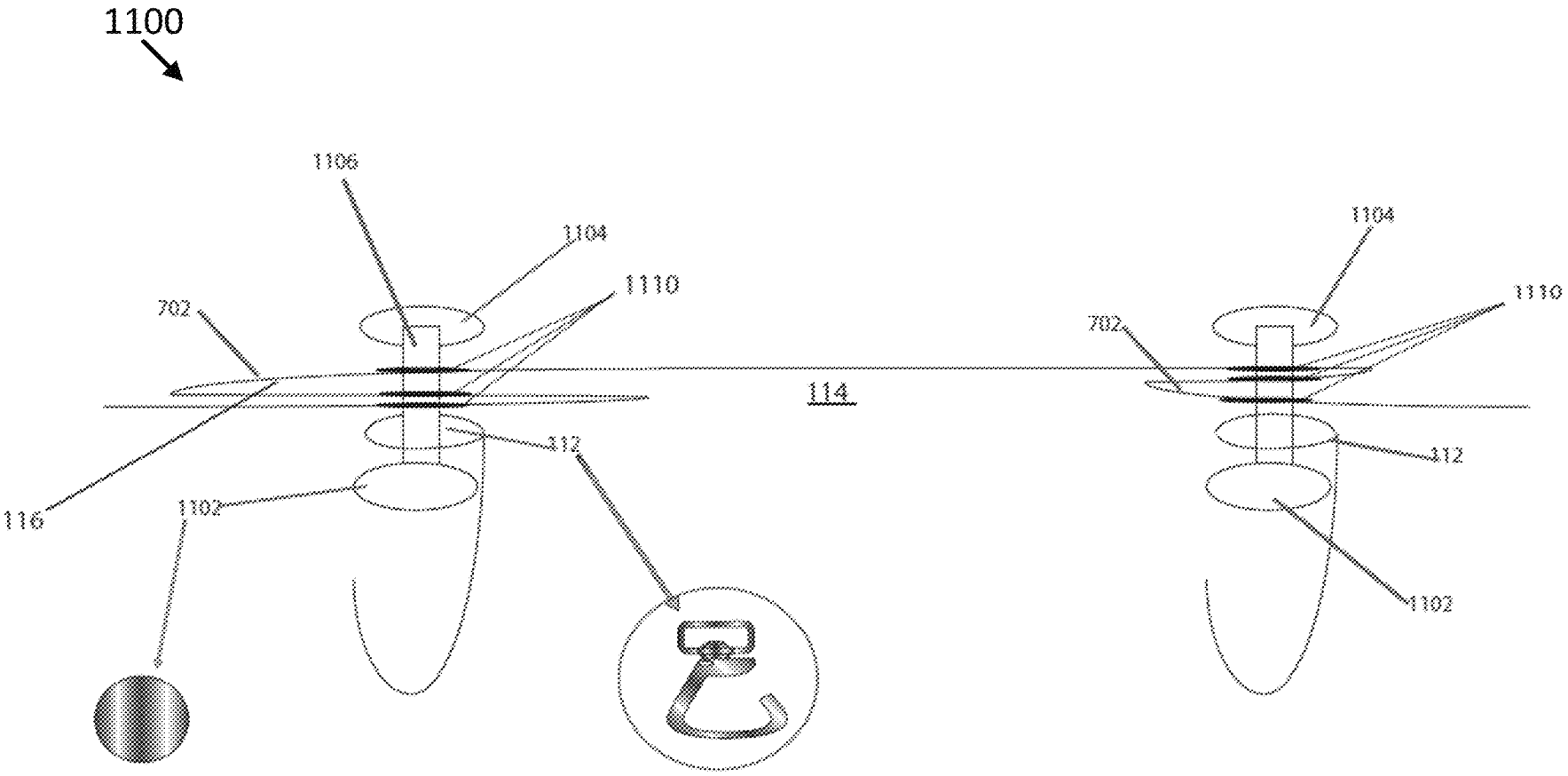
FIG. 11A is a diagram illustrating a hook system on an interior of a coat, according to the present disclosure.

FIG. 11A is a diagram illustrating a hook system 1100 on an interior of a coat, according to the present disclosure. In FIG. 11A, in further embodiments, the strap system 102 can be omitted. Accordingly, a hook system 1100 can include grommets 1110 through layers of the box pleat 116 to enable a post 1106 to pass therethrough and be secured on both sides with a threaded post 1104 and threaded end 1102.

Figure 11B:
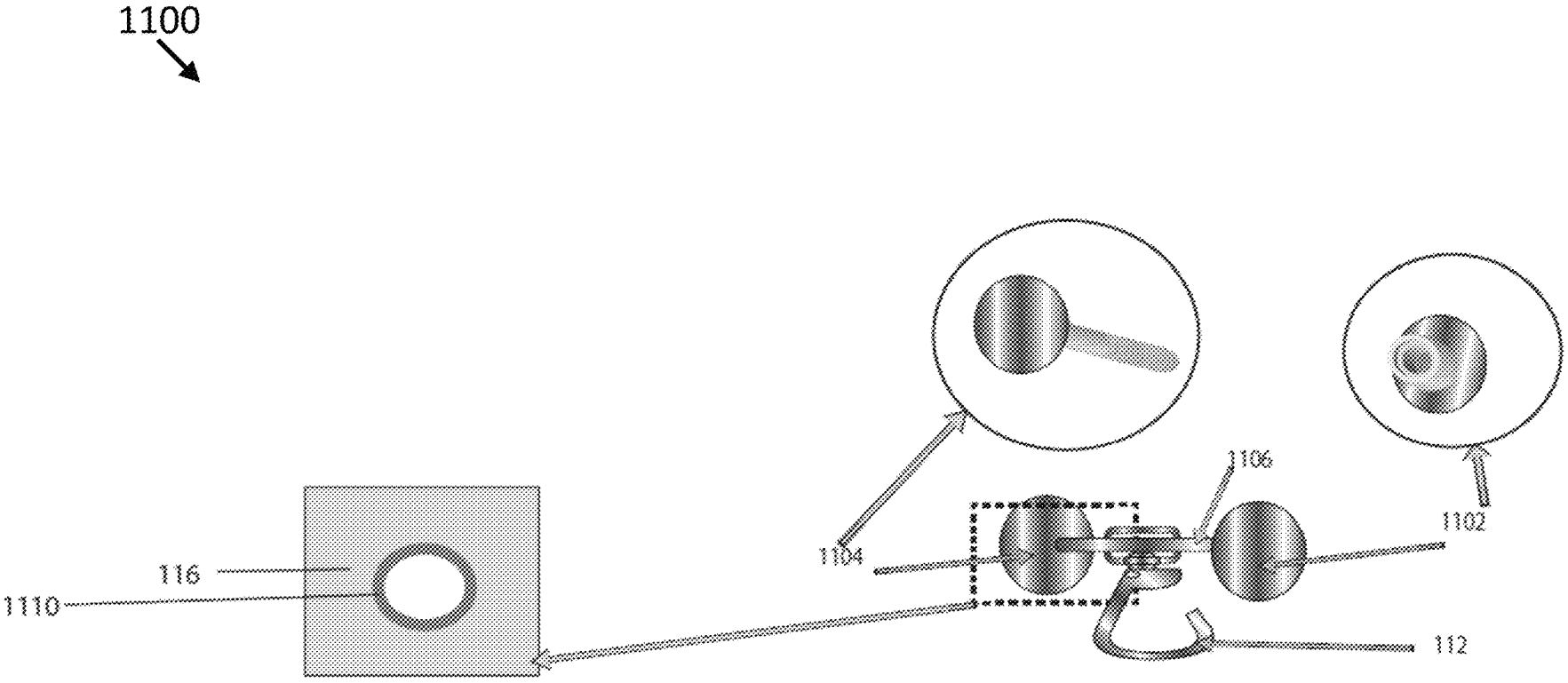
FIG. 11B is a diagram illustrating a detailed view of a hook system on an interior of a coat, according to the present disclosure.

FIG. 11B is a diagram illustrating a detailed view of the hook system 1100 on an interior of a coat, according to the present disclosure. In FIG. 11B, the end post 1104 mates with through threaded post 1106 with the threaded end post 1102 to secures the hooks 112 through the grommet holes 1110 in the fabric of the pleat 116. Although the present disclosure is described in terms of a grommet and strap system, any suitable ways to add purse hooks, and the like, on the interior of the coat, and the like, can be employed, based on the teachings of the present disclosure, as will be appreciated by those of ordinary skill and the relevant art(s).

While the present disclosure has been described in connection with a number of illustrative embodiments, and implementations, the present disclosure is not so limited, but rather cover various modifications, and equivalent arrangements, which fall within the purview of the appended claims.

What is claimed is:

1. A coat system, comprising:

a coat with an outer shell and an interior lining defining an interior space configured for carry, storage, and concealment of items including at least one of a handbag and a pet carrier;

a strap system disposed between the outer shell and the interior lining of the coat, the strap system including a plurality of structural straps extending around and behind a neck region of the coat and extending down opposing interior sections of the coat;

a plurality of hooks mechanically coupled to the strap system, wherein the at least one of the handbag or the pet carrier can be connected to the hooks;

a pleated section formed in a lower portion of the coat, the pleated section comprising box pleats configured to define a concealment cavity for visually obscuring the at least one of the handbag or the pet carrier when suspended within the interior space of the coat; and a hood including a weighted element including beads or sand distributed in separate compartments integrated into the hood and configured to enable the hood to stay on a head of a user.

2. The coat system of claim 1, further comprising: a built-in bag within the interior space of the coat, the built-in bag being integrated with the strap system.

3. The coat system of claim 1, further comprising: a built-in pet carrier within the interior space of the coat, the built-in pet carrier being integrated with the strap system.

4. The coat system of claim 1, wherein the weighted element is integrated into a top of the hood of the coat system.

5. The coat system of claim 1, wherein the weighted element is configured to distribute weight evenly on a top of the hood of the coat system.

6. The coat system of claim 1, wherein the concealment cavity is sized and arranged to receive and conceal the at least one of the handbag or the pet carrier within the interior space.

7. The coat system of claim 1, wherein the interior space further includes a built-in bag or a built-in pet carrier secured to the strap system, the built-in bag or the built-in pet carrier being supported by the plurality of structural straps.

8. The coat system of claim 7, wherein the interior space includes the built-in pet carrier, wherein the built-in pet carrier includes mesh ventilation panels on opposing sides of the built-in pet carrier, and the built-in pet carrier further includes a mesh front panel with a zipper opening.

9. The coat system of claim 1, wherein the strap system includes adjustable connectors configured to accommodate attachment of the strap system to different types of handbags or pet carriers.

10. The coat system of claim 1, wherein the strap system further includes a set of retractable hooks or clasps configured to provide support and security.

11. The coat system of claim 1, wherein the strap system is formed from webbing selected from nylon, polyester, polypropylene, or a combination thereof.

12. The coat system of claim 1, wherein the plurality of hooks comprises a first hook positioned in an upper portion of the coat interior lining for smaller handbags and two lower hooks positioned beneath the first hook for larger handbags with long straps.

13. The coat system of claim 1, wherein the box pleats forming the concealment cavity are disposed on opposing sides of the lower portion of the coat to define opposing box cavities.

14. The coat system of claim 1, wherein the plurality of hooks are mounted to posts passing through grommets in the pleated section and secured by threaded ends.

* * * * *